United States Patent [19]

Bar-on et al.

[11] Patent Number: 5,029,821

[45] Date of Patent: Jul. 9, 1991

[54] APPARATUS FOR CONTROLLING THE MAGNESIUM CONTENT OF MOLTEN ALUMINUM

[75] Inventors: Ari Bar-on; Kenneth L. Gallaher; Jonathan S. Greenberg, all of Shaker Heights; David V. Neff, Euclid; Douglas H. Rothenberg, Shaker Heights, all of Ohio

[73] Assignee: The Carborundum Company, Niagara Falls, N.Y.

[21] Appl. No.: 444,684

[22] Filed: Dec. 1, 1989

[51] Int. Cl.[5] ..... F27D 19/00

[52] U.S. Cl. ..... 266/79; 75/385; 75/681

[58] Field of Search ..... 75/385, 681; 266/79, 266/80, 81, 159

[56] References Cited

U.S. PATENT DOCUMENTS

| | | | |
|---|---|---|---|
| 3,850,660 | 11/1974 | Inamura et al. | 427/28 |
| 3,958,980 | 5/1976 | Szekely | 75/681 |
| 4,288,062 | 9/1981 | Gupta et al. | 266/80 |

*Primary Examiner*—Melvyn J. Andrews

*Attorney, Agent, or Firm*—L. W. Evans; J. G. Curatolo; S. A. McCollister

[57] ABSTRACT

A method for controlling the magnesium content of molten aluminum includes the steps of injecting a halogen gas into the molten aluminum, sampling a portion of the resulting gases evolved from the molten aluminum, detecting the presence of constituents in the sampled gases and/or characteristics of the sampled gases indicative of the imminent evolution of unreacted halogen gas, and adjusting the rate of halogen gas injection to approach the point where unreacted halogen gas is about to be evolved. In the preferred embodiment, the halogen gas is chlorine; the detected constituents are gaseous hydrogen chloride (CHl) and aluminum chlorhydrate compounds ($Al_2Cl_x \cdot (OH)_{6-x}$); and the detected characteristic is the opacity of the sampled gases. The invention includes a technique for adjusting the rate of halogen gas injection so as to approach the optimal rate. The invention also includes (1) a sensor for detecting the content of HCl and $Al_2Cl_x \cdot (OH)_{6-x}$ and the opacity of the withdrawn gases, (2) apparatus for controlling the injection of halogen gas in response to detected conditions, and (3) molten aluminum having a desired content of magnesium produced by the method according to the invention.

6 Claims, 2 Drawing Sheets

APPARATUS FOR CONTROLLING THE MAGNESIUM CONTENT OF MOLTEN ALUMINUM

BACKGROUND OF THE INVENTION

1. Field of the Invention.

The invention relates controlling the content of magnesium in molten aluminum and, more particularly, to a method and apparatus for injecting halogen gas into the molten aluminum, sensing various characteristics of gases evolved in response to the injection of the halogen gas, and controlling the injection of halogen gas so as to produce evolved gases having desired characteristics (and, concurrently, a desired content of magnesium in the molten aluminum).

2. Description of the Prior Art.

In the production of molten aluminum, it is desirable to control, i.e. reduce or remove, excessive quantities of magnesium. Desirably, the magnesium content of the molten aluminum will be reduced to low levels, for example, less than about 0.2 percent by weight. If the magnesium content of the molten aluminum is excessive, the molten aluminum may be unsuitable for further die cast and foundry ingot production. Unfortunately, recycled aluminum, particularly used beverage containers, often contains a high content of magnesium that must be reduced to low levels before further processing is possible.

An additional problem in the processing of recycled aluminum is the removal of hydrogen. It is desirable to remove hydrogen from molten aluminum because if the hydrogen is not removed before the molten aluminum solidifies into a cast product, gaseous defects in the form of gas holes, blows, and microporosity can result in impaired physical and mechanical properties of the resultant cast aluminum.

Yet an additional concern relates to the removal of alkali metal impurities such as lithium, calcium, and sodium. While these impurities usually are present in small concentrations of less than 100 parts per million, they nevertheless can be quite detrimental. In particular, if the resultant cast aluminum is flat-rolled, the alkali metal impurities can cause cracking and tearing in subsequent fabrication operations.

The usual technique for removing, or reducing, the noted impurities is the injection of a "cleansing gas" into the molten aluminum. A typical cleansing gas includes an inert gas such as nitrogen or argon, together with halogen compounds containing chlorine and/or fluorine. While chlorine is the preferred halogen gas, and while most of the discussion herein will be with respect to chlorine, it is to be understood that the present invention is amenable to use with chlorine, fluorine or any of the other halogen gases, either alone or in combination with other gases. Also, while the term "demagging" is used herein to describe the reduction or removal of magnesium to desired low levels, it is to be understood that such term also includes the reduction or removal of hydrogen and alkali earth metals.

In the demagging of molten aluminum with chlorine, the following primary reactions occur:

$$\tfrac{2}{3}\,Al + Cl_2 \rightarrow \tfrac{2}{3}\,AlCl_3$$

$$\tfrac{2}{3}\,AlCl_3 + Mg \rightarrow MgCl_2 + \tfrac{2}{3}\,Al$$

When gaseous chlorine is introduced into molten aluminum, gaseous aluminum chloride is formed which further decomposes to react with magnesium that is present. The resultant product, magnesium chloride ($MgCl_2$), is a liquid phase which is less dense than aluminum and which therefore rises ultimately to the surface in the form of dross, where it may be removed by skimming. Kinetic factors such as rate of mixing and contact area also have an effect on the efficiency of the magnesium removal process. Accordingly, the addition of chlorine by itself does not guarantee effective magnesium removal.

For a stoichiometric reaction, 2.95 pounds of chlorine are required to remove one pound of magnesium. However, if process factors are such that the reaction is not efficient, substantially more than 2.95 pounds of chlorine may be required. Inefficient reactions waste time, consume excessive chlorine, and usually result in substantial emissions and fumes, creating environmental hazards and corrosion problems. Unreacted chlorine, aluminum chloride, and complex oxychlorides react with moisture in the air to create acidified products that corrode most metal structures, even stainless steels. Hence, demagging processes must be both favorable and efficient for secondary smelting and recycling applications.

Heretofore, several techniques have been utilized to demag molten aluminum. Aluminum chloride and fluoride salts have been used individually, and chlorine salt fluxes plus chlorine injection also have been used. While these techniques can produce very good demagging efficiency, reaction times are long and they can produce excessive emissions and also present salt flux disposal problems. The so-called "scrubber bell" process uses chlorine gas injection and captures the resultant emissions under a hood or bell. These emissions subsequently require scrubbing with water before discharge, and consequently the overall treatment and disposal costs can be prohibitive.

The most common technique in use today for demagging molten aluminum is the injection of gaseous chlorine by means of a circulation/gas injection pump. The pump employs an impeller that creates a high velocity molten metal discharge which shears gas being injected through a so-called injection tube. This creates a very wide dispersion of extremely small bubbles which improves the efficiency of the demagging process. The high surface area associated with the very small bubbles results in very high reaction rates between the chlorine, aluminum, and magnesium. Thus, favorable reaction kinetics are achieved, as well as favorable thermodynamics.

Despite the effectiveness of the demagging operation by the use of a circulation/gas injection pump, certain problems have not been addressed. One of these problems relates to controlling the rate of chlorine injection so that adequate chlorine is available for reaction purposes, but excessive chlorine is not injected into the melt. If excessive chlorine is injected into the melt, unreacted chlorine will be contained in the gases being evolved from the molten aluminum. "Unreacted chlorine" as used herein means not only gaseous chlorine per se, but also aluminum chloride ($AlCl_3$) that has not reacted with magnesium contained in the molten aluminum. The presence of unreacted chlorine in the gases evolved from the molten aluminum is quite undesirable, as noted earlier. Similarly, the term "unreacted halogen gas" as used herein means halogen gas that has not reacted with magnesium contained in the molten aluminum, thereby leading to the emission of undesirable by-products from the molten aluminum.

The most common technique for controlling the rate of chlorine injection is a manual one, where the pump operator observes the evolved gases and increases the pump speed and/or reduces the chlorine supply upon observing a white plume indicative of excessive chlorine consumption.

Another technique for controlling chlorine injection is to take metallurgical samples of the melt and analyze the samples for magnesium content (by atomic absorption or optical emission spectroscopy). A problem with taking metallurgical samples and analyzing them is a significant lag time between chlorine injection and a resultant affect on magnesium content. While the previously described visual observation technique and the metallurgical sample technique sometimes are used in combination, they still represent an "after-the-fact" determination of proper chlorine injection flow rate.

Another technique that has been used to control chlorine injection flow rate is that of an on-line melt sensor (electrode) that senses the magnesium content of the melt. Although a melt sensor is useful to determine the state of the demagging process, it, like the previously described techniques, is an after the fact technique that cannot be used to optimize the rate of chlorine injection as the demagging process is occurring.

Desirably, a technique would be available to control the rate of chlorine injection that would attain maximum demagging efficiency while minimizing the discharge of unreacted chlorine. In effect, it is desired to be able to limit the rate of chlorine injection prior to, or at the onset of, undesirable emissions. It also would be desirable for any such control technique to be usable with a wide variety of furnace configurations and to present minimal difficulties in installing any necessary equipment and for any such installed equipment to be as unobtrusive as possible. Yet an additional concern relates to making the control technique as automatic in operation as possible, so that control decisions by the operator are reduced or eliminated.

SUMMARY OF THE INVENTION

In response to the foregoing concerns, the present invention provides a new and improved method and apparatus for controlling the magnesium content of molten aluminum. In its broadest form, the invention includes the steps of injecting a halogen gas into the molten aluminum, sampling a portion of the resulting gases evolved from the molten aluminum, detecting the presence of constituents in the sampled gases and/or characteristics of the sampled gases indicative of the imminent evolution of unreacted halogen gas, and adjusting the rate of halogen gas injection to approach the point where unreacted halogen gas is evolved. In the preferred embodiment, the halogen gas is chlorine; the detected constituents are gaseous hydrogen chloride (HCl) and aluminum chlorhydrate compounds ($Al_2Cl_x \cdot (OH)_{6-x}$); and the detected characteristic is the opacity of the sampled gases. The invention includes a technique for adjusting the rate of halogen gas injection so as to approach the optimal rate. The invention also includes (1) a sensor for detecting the content of HCl and $Al_2Cl_x \cdot (OH)_{6-x}$ and the opacity of the withdrawn gases, (2) apparatus for controlling the injection of halogen gas in response to detected conditions, and (3) molten aluminum having a desired content of magnesium produced by the method according to the invention.

By use of the present invention, the magnesium content of molten aluminum can be reduced to desirable low levels on the order of 0.2 percent by weight or less without the evolution, or substantially without the evolution, of unreacted halogen gas. In contrast with prior halogen gas injection control techniques, the present invention results in less environmental pollution, less corrosion of buildings and equipment, less cost associated with aluminum melt processing, and more efficiency of the demagging process. A feature of the present invention is that it enables halogen gas injection to be controlled substantially automatically, thereby permitting optimal demagging efficiency to be attained without manual input from an operator.

DESCRIPTION OF THE PREFERRED EMBODIMENT

Figure 1:
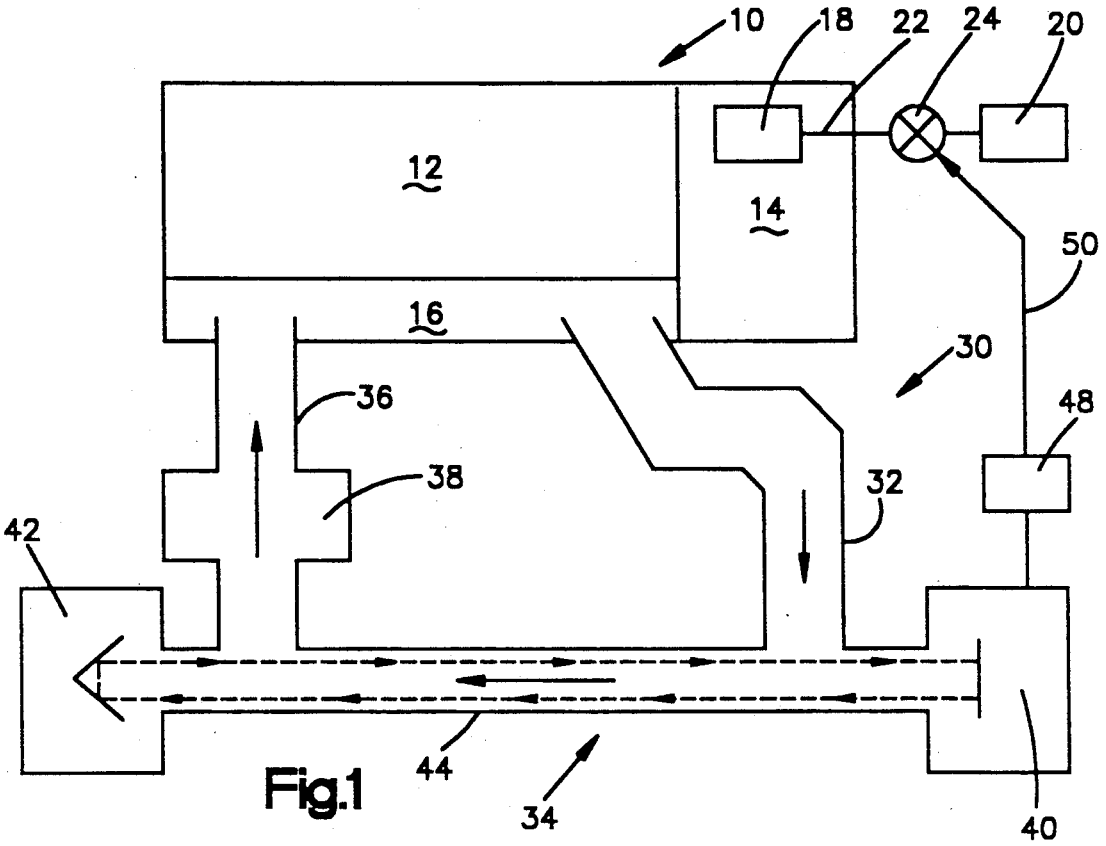
FIG. 1 is a schematic plan view of a reverberatory furnace used for the melting and demagging of molten aluminum, and apparatus according to the invention for controlling the rate of halogen gas injection to attain optimal demagging efficiency.

Referring to FIG. 1, apparatus for melting aluminum and injecting halogen gas thereinto is indicated generally by the reference numeral 10. The apparatus 10, as schematically illustrated, includes a reverberatory furnace 12 having a pump well 14 and a charge well 16. A circulation/gas injection pump 18 is disposed within the pump well 14. A source of halogen gas 20 enables gas to be injected into the molten aluminum by way of an injection tube 22 and an electrically operated control valve 24. A conveyor or similar charging apparatus (not shown) is disposed above the charge well 16 in order to deposit particles of unmelted scrap into the charge well 16.

In operation, molten aluminum contained within the furnace 12 is circulated from the furnace 12 into the pump well 14, from the pump well 14 into the charge well 16, and from the charge well 16 back into the furnace 12. The pump 18 disposed within the pump well 14 not only causes the molten metal to circulate, but it also permits halogen gas to be injected into the molten aluminum through the tube 22. A suitable circulation/-gas injection pump 18 is commercially available from the Metaullics Systems Division of The Carborundum Company, 31935 Aurora Road, Solon, Ohio 44139, under Model No. M28-CSD-$Cl_2$.

It is to be understood that the apparatus 10 is disclosed for illustrative purposes only. The invention is usable with any furnace configuration or vessel, and it may be used in conjunction with any type of gas injection device such as a lance, flux tube, rotor disperser, or gas injection pump. Regardless of the technique employed to inject gas into the molten metal, it is important that the gas be injected as uniformally as possible and with bubbles as small as possible. Further, it is important that the gas be injected in the right quantity for conditions prevailing at any given time. If too little gas is injected, then proper demagging will not occur; if too much gas is injected, then unreacted halogen gas will be evolved from the molten aluminum. Further, the present invention is usable with any gas injection process where halogen gas injection is desirable, including those processes where demagging is no involved.

The present invention provides a technique by which the demagging of the molten aluminum can be controlled accurately, with little or no emission of unreacted halogen gas into the atmosphere. It has been discovered that certain gases are evolved from the molten aluminum shortly before, or at, that point where unreacted halogen gas is evolved. It also has been discovered that the characteristics of the evolved gas will change at that point where unreacted halogen gas is about to be evolved. The invention makes use of these discoveries by providing a technique for sampling a portion of the gases evolved from the molten aluminum, detecting the presence of constituents in the sampled gases or characteristics of the sampled gases indicative of the imminent evolution of unreacted halogen gas, and adjusting the rate of halogen gas injection to approach the point where unreacted halogen gas is evolved.

Figure 2:
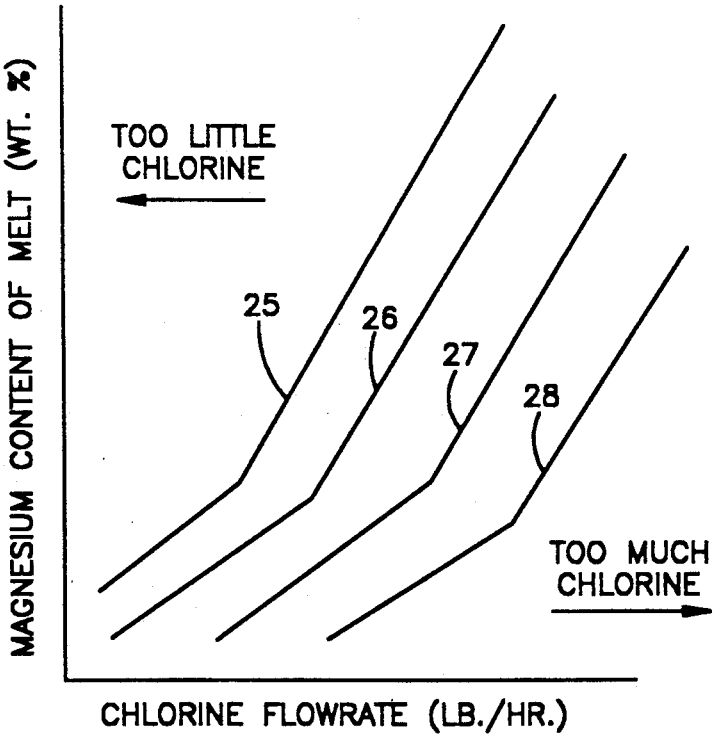
FIG. 2 is a plot of characteristic curves for demagging molten aluminum by the injection of chlorine as a function of increasing melt temperature and increasing dispersion of chlorine gas in the melt.

Referring to FIG. 2, characteristic curves are shown for the chlorine demagging of aluminum as a function of increasing melt temperature and increasing dispersion of chlorine gas in the melt. Line 25 is a critical curve for a low melt temperature and a low degree of gas dispersion. The term "critical curve" represents the dividing line between too little chlorine being use for demagging, and too much chlorine being used for demagging, i.e., unreacted chlorine being evolved from the molten aluminum. As shown in FIG. 2, the region to the left of line 25 represents the use of too little chlorine, while the region to the right of line 25 represents the use of too much chlorine. Lines 26, 27 and 28 in FIG. 2 represent increasing melt temperature and/or degree of gas dispersion. It can be concluded from an analysis of FIG. 2 that the amount of chlorine required to properly demag the molten aluminum is directly proportional to the melt temperature and degree of gas dispersion.

Figure 3:
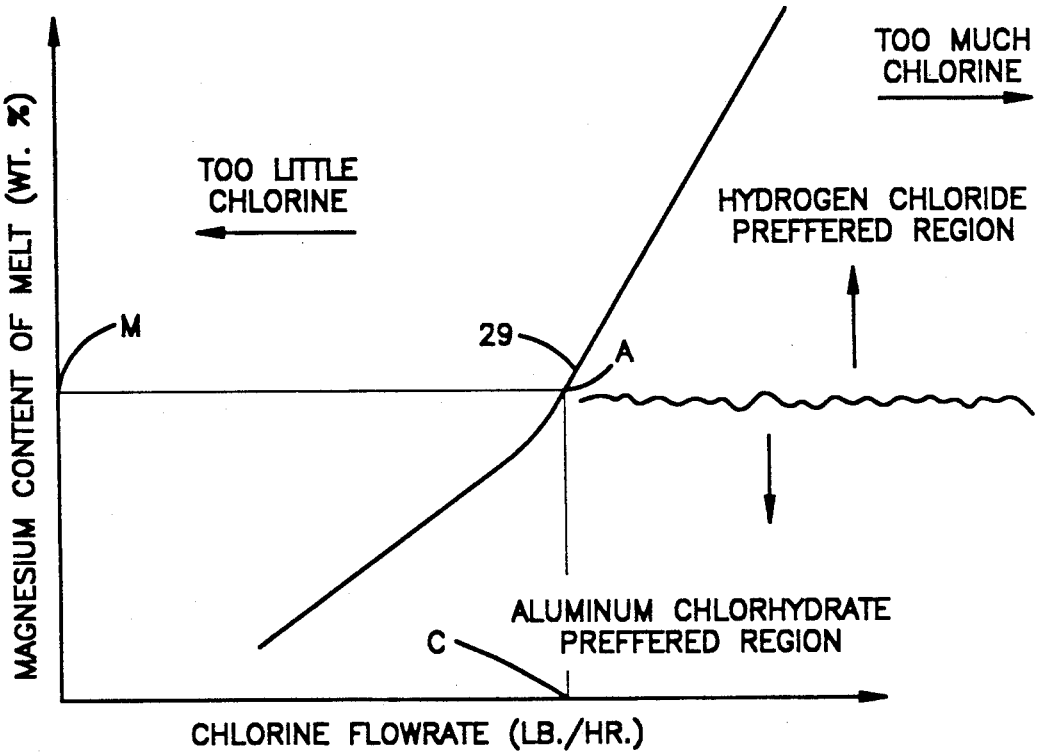
FIG. 3 is a plot of a characteristic curve for chlorine demagging at a given melt temperature and given chlorine dispersion.

Referring now to FIG. 3, a critical curve for the demagging of molten aluminum by the use of chlorine gas as shown. The curve is indicated by the reference numeral 29. Curve 29 has been selected for a given melt temperature and degree of gas dispersion. As in the curves as shown in FIG. 2, the region to the left of curve 29 is indicative of the consumption of two little chlorine, while the region to the right of curve 29 is indicative of the consumption of too much chlorine.

An important feature of the present invention is the discovery that the evolution of certain gases from the melt and/or changes in characteristics of the gases evolved from the melt are an indication that unreacted halogen gas has started to be evolved, or is about to be evolved. In particular, it has been discovered that the evolution of gaseous hydrogen chloride (HCl), aluminum chlorhydrate in any of its various forms (denotated here as $Al_2Cl_x \cdot (OH)_{6-x}$, or an increase in optical opacity signals the imminent evolution of unreacted chlorine. If one or more of the foregoing factors are sensed, then the rate of chlorine injection must be reduced if the evolution of unreacted chlorine is to be avoided.

The foregoing factors are illustrated in FIG. 3 where the region to the lower right of curve 29 is indicated as a region of "aluminum chlorhydrate preferred region." Similarly, the region to the upper right of curve 29 is indicated as the "hydrogen chloride preferred region." The existence of preferred regions is believed to be correct based on observations made to date, but the observations have not been confined experimentally. FIG. 3 shows that for high magnesium-content aluminum, more hydrogen chloride will be evolved than aluminum chlorhydrate. As the content of magnesium decreases, the evolution of hydrogen chloride decreases and the evolution of aluminum chlorhydrate increases. At the lowest magnesium levels, more aluminum chlorhydrate is evolved than hydrogen chloride. FIG. 3 thus confirms the present belief that the ratio of emissions changes over different regions of the operating space.

Referring again to FIG. 1, apparatus suitable for detecting the presence of HCl, $Al_2Cl_x \cdot (OH)_{6-x}$, and/or an increase in optical opacity is indicated generally by the reference numeral 30. The apparatus 30 includes an intake duct 32, a gas analyzer 34 connected to the duct 32, and a discharge duct 36 connected to the analyzer 34. A blower 38 is disposed in the duct 36. The ducts 32, 36 are approximately eight inches in diameter and include openings disposed about 6–8 feet above the surface of the melt. Similarly, the center section of the analyzer 34 includes an eight-inch diameter pipe. The overall length of the analyzer 34 is about 10 feet, and the length of the analyzer 34 between the spaced ducts 32, 36 is about 7.5 feet.

In order to avoid corrosion of the ducts 32, 36, they are formed of epoxy-coated black iron. Any suitable material resistant to corrosive emission products would be acceptable. The blower 38 is disposed inline in the discharge duct 36 (rather than in the duct 32) in order to reduce interferences with the effluent off-gas. A suitable blower can be obtained commercially from the Tjernlund Company, Model No. HS-3 4C729. The nominal velocity of gas drawn through the analyzer 34 should be within the range of about 5–15 feet per second.

The analyzer 34 includes a sensor portion 40, a retroreflector portion 42 that is spaced from the sensor portion 40, and a conduit 44 that connects the sensor portion 40 and the retroreflector portion 42. The portions 40, 42 are commercially available from Air Instruments & Measurements, Inc., San Dimas, Calif. 91773, Model No. E-6023. The analyzer 34 operates on the non-dispersive infrared absorption spectroscopy method and gas filter correlation method. The sensor portion 40 projects a beam of infrared light to the retroreflector portion 42 which returns the beam to the sensor portion 40. Various filters contained within the sensor portion 40 condition the infrared signal in response to the presence of constituents and/or characteristics of gas disposed intermediate the portions 40, 42. In general, the greater the distance between the portions 40, 42, the more sensitive the analyzer 34 will be. In the example illustrated, the portions 40, 42 are spaced approximately 10 feet, making a total path length of about 20 feet. The filters selected for use with the sensor portion 40 enable the sensor portion 40 to sense the presence of gaseous HCl, $Al_2Cl_x \cdot (OH)_{6-x}$ in its various forms, and opacity.

Figure 4:
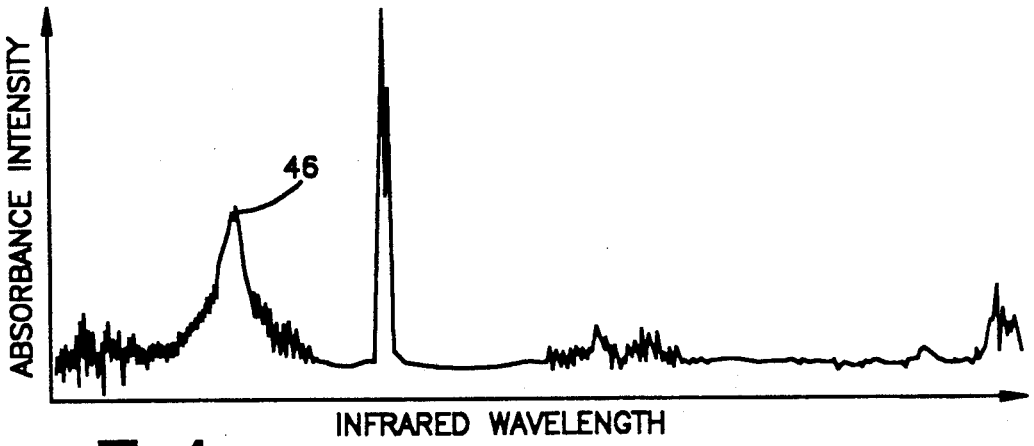
FIG. 4 is a plot of absorbence intensity versus infrared wavelength for gases evolved from molten aluminum during chlorine injection.

Referring particularly to FIG. 4, a curve illustrating the infrared spectrum of charge well emissions is shown. That portion of the curve bearing the reference numeral 46 corresponds to the presence of $Al_2Cl_x \cdot (OH)_{6-x}$ in the beam path. When the sensor portion 40 detects the presence of $Al_2Cl_x \cdot (OH)_{6-x}$ as determined by the frequency spectrum shown in FIG. 4, a control signal will be generated by a control device 48 (see FIG. 1) that can be used to adjust the rate of chlorine injection, as will be described.

In the course of injecting chlorine into the molten aluminum, various off-gases are evolved from the melt. The primary emission when there is excessive injection of chlorine is aluminum chloride gas ($AlCl_3$). This is a relatively low boiling point, highly reactive material which is likely to solidify and/or react before passing through a sampling system. Aluminum chloride reacts rapidly with ambient water to form aluminum chlorhydrate ($AlCl_3$) $(H_2O)_3$ followed by decomposition to other chlorhydrates and hydrogen chloride gas (HCl). Typical reactions are as follows:

$$2Al+3Cl_2 \rightarrow Al_2Cl_6(gas)$$
$$Al_2Cl_6+6(H_2O) \rightarrow Al_2Cl_6 \cdot 6(H_2O)$$
$$Al_2Cl_6 \cdot 6(H_2O) \rightarrow Al_2Cl_x(OH)_{6-x}+HCl$$

Hydrogen chloride is chosen as a component to be sampled because it is the most prevalent off-gas component that can be detected. Aluminum chlorhydrate is chosen for detection due to its significant presence in full-spectrum infrared, experimentally observed data. In addition to the foregoing components of the off-gas that are detected, a characteristic of the evolved gas, namely, opacity, is determined because (1) it is analogous to the current visual approach used for the control of chlorine injection, and (2) opacity analyzers are relatively inexpensive. Particles within the range of 3–30 microns can be detected, which would be condensates of various chlorhydrates, as well as solid combustion products.

In addition to the foregoing, other components could be detected. For some very inefficient operations, chlorine itself could be the sampled component. Chlorine cannot be detected by infrared techniques, however.

Operation

It will be assumed that the furnace 12 is being operated in a conventional manner to maintain aluminum in a molten state and to melt additional aluminum scrap that is being introduced into the charge well 16. The pump 18 disposed in the pump well 14 is circulating the molten aluminum and is injecting chlorine into the melt. The melt temperature is about 1400° F. The initial chlorine flow rate will be dependent upon the magnesium content of the melt and the volume of the melt, among other factors, but an initial rate of 200 pounds per hour is acceptable in most cases.

The blower 38 is activated so as to induce a flow of off-gas from the surface of the melt in the charge well 16 through the duct 32, through the analyzer 34, and back into the charge well 16 by means of the discharge duct 36. During passage of the gas through the analyzer 34, the portions 40, 42 are operated to detect the presence (or absence) of HCl, $Al_2Cl_x \cdot (OH)_{6-x}$ and/or an increase in opacity due to the existence of particles within the range of 3–30 microns. If the analyzer 34 detects one or more of the foregoing factors, then a control signal from the control device 48 will be directed to the control valve 24 through a line 50 so as to reduce the rate at which chlorine is being injected into the melt. The analyzing process can be conducted relatively frequently, on the order of every 30 seconds or so, so that the rate of chlorine injection can be continuously adjusted to approach that point where unreacted chlorine will be evolved from the melt, without actually reaching that point.

The foregoing methodology represents a basic, and effective, technique for controlling the magnesium content of the molten aluminum without causing the evolution of unreacted chlorine. If desired, the methodology can be adjusted to accomplish additional objectives. In the normal course of the operation of the furnace 12, various unwanted by-products usually are formed. These by-products often appear in the form of floating dross. The dross, if allowed to accumulate, can blanket the charge well 16 and interfere with the normal off-gas migration. Additionally, from time to time, a fluxing salt is added to the melt to assist in the processing. This flux can produce off-gas components of its own, as well as interfere with the normal off-gas migration due to demagging by chlorine injection. Although the dross is removed periodically by mechanical means, during its removal the normal off-gas flow is disturbed. If the dross blanket is allowed to partially or completely prevent the release of off-gases, then during removal of the dross, the off-gas flow might appear quite erratic in composition and flow. Hence, the chemical composition of the off-gas, as well as its flow rate, might vary considerably. In addition, oils, paint, and other materials introduced with the scrap directed into the charge well 16 can produce smoke and other combustion products which also will become part of the off-gas. The foregoing disturbances that normally occur in the charge well 16 can cause significant changes in the composition of the off-gas. If not properly accounted for, chlorine injection control based upon off-gas an lysis will not properly track the true nature of the demagging process.

A control strategy that properly tracks the actual demagging process desirably includes a procedure for the interpretation of the analyzer results, a procedure for validating the analyzer results by conducting "experimental probes" of the operating region, and a procedure for calculating the desired chlorine flow rate. The control strategy will be described below.

Due to the large volume of the furnace (even if it is partially full), and due to the relatively small proportion of the volume represented by the periodic charging of scrap metal, including any delays in melting, it is a good assumption that the variation of magnesium in the total melt must change slowly. By similar argument, the melt temperature also will change slowly. If the degree of dispersion of the chlorine gas is held constant (by maintaining a constant pump geometry and pump speed), then the chlorine flow rate needed to follow the critical curves as shown in FIGS. 2 and 3 also must vary slowly. Therefore, any rapid variations in the off-gas composition/characteristics must be due to furnace disturbances such as dross build-up, dross skimming, charging, fluxing, variations in pollution control devices, and the like, and not due to inherent changes in the necessary chlorine flow needed for proper demagging. Hence, the control system can safely assume that the correct critical value of chlorine is very near the present one. Thus, the control system can slowly make small corrections in chlorine flow rate in order to follow the critical curve that exists for any given temperature and gas dispersion.

A starting point for the control system is the correct identification at a given point in time of the critical amount of chlorine flow. This condition is represented schematically as point "A" in FIG. 3. At this point, and at a given (1) melt temperature, (2) degree of gas dispersion in the melt, and (3) amount of magnesium (M) in the melt, the critical amount of chlorine flow is represented by point "C." The amount of chlorine needed for proper demagging will change slowly and that change generally should follow the critical curve 29. Using a model of the critical curve 29, the chlorine rate can be adjusted even if the gases sampled by the analyzer 34 are erratic. All that is necessary is that the off-gas disturbances should have time to die down.

At the same time that the control system is making slow corrections based upon a model of the critical curve 29, it also will be making a controlled series of probes into the melt. The term "probes" as used herein means a relatively rapid increase or decrease of chlorine flow on the order of 25 pounds per hour so as to determine the impact of such increased or decreased chlorine flow on the sensor 34. The probes are conducted quickly (over about 5–10 minutes) in relation to the slow process changes that are occurring, and the analyzer results are observed. In short order a new critical point will be discovered. If the new value is close to the previous known value, it will be accepted as the new known value. If it is not close, then the process is presumed to be in an upset condition. The chlorine flow will continue to be controlled according to the curve 29. After a small waiting period, the probing is initiated again. Adjustments of waiting time, sequence of probe steps, number of experiments, and the interpretation procedure are used to ensure correctness.

By proceeding in the foregoing manner, the critical curve 29 will be followed during the demagging process. Following the critical curve 29 ensures that the demagging process will proceed at as rapid a rate as possible while, at the same time, the use of chlorine and any undesired off-gas emissions will be minimized.

As is apparent from the foregoing description, the magnesium content of molten aluminum can be reduced to desirable low levels on the order of 0.2 percent by weight, or less, without the evolution, or substantially without the evolution, of unreacted halogen gas. In contrast with prior halogen gas injection control techniques, the present invention results in less environmental pollution, less corrosion of buildings and equipment, less cost associated with aluminum melt processing, and more efficiency of the demagging process. Because the injection of gas is controlled substantially automatically, optimal demagging efficiency can be attained without manual input from an operator. The present invention is usable with a wide variety of furnace configurations and presents minimal installation difficulties. The installed equipment also is relatively unobtrusive.

Although the invention has been described in its preferred form with a certain degree of particularity, it will be understood that the present disclosure of the preferred embodiment has been made only by way of example and that various changes may be resorted to without departing from the true spirit and scope of the invention as herein claimed. By way of example, and without limitation, the sampling of evolved gases conducted pursuant to the invention could be accomplished by arranging the analyzer 34 so as to scan directly across the charge well 16, thereby eliminating the ducts 32, 36 and the blower 38. It is intended that the patent shall cover, by suitable expression in the appended claims, whatever features of patentable novelty exist in the invention disclosed.

What is claimed is:

1. Apparatus for controlling the magnesium content of molten aluminum, comprising:

means for injecting halogen gas into the molten aluminum;

pipe means for sampling gases evolved from the molten aluminum disposed above the surface of the molten aluminum through which samples gases are drawn.

means for detecting HCl and $Al_2Cl_x{\cdot}(OH)_{6-x}$ in the sampled gases comprising a sensor that generates an infrared beam of light, a means for receiving the beam of light and reflecting it back to the means for generating the beam of light, a conduit connecting the means for generating the beam of light and the means for receiving and reflecting the beam of light, the conduit permitting gas evolved from the molten aluminum to flow therethrough and permitting the beam of light to be passed back and forth between the means for generating and the means for receiving and reflecting, and filter means included as part of the means for generating for sensing changes in the wavelength of the infrared beam of light corresponding to the presence of HCl and $Al_2Cl_x{\cdot}(OH)_{6-x}$ in the evolved gases; and means for adjusting the rate of halogen gas injection so as to approach the point where unreacted halogen gas is evolved.

2. The apparatus of claim 1, wherein the means for sampling is not susceptible to attack by unreacted halogen gas.

3. The apparatus of claim 2, wherein the means for sampling includes conduits formed of epoxy-coated iron.

4. The apparatus of claim 1, wherein said detecting means further detects opacity within the particle size range of 3–30 microns.

5. The apparatus of claim 1, wherein the means for adjusting the rate of halogen gas injection is an electrically-controlled valve.

6. The apparatus of claim 1, wherein the means for injecting halogen gas is in the form of a circulation/gas injection pump.

* * * * *